US007809471B2

(12) United States Patent
Murakami et al.

(10) Patent No.: US 7,809,471 B2
(45) Date of Patent: Oct. 5, 2010

(54) ENVIRONMENTAL APPARATUS CONTROL SYSTEM

(75) Inventors: Yoshifumi Murakami, Ibaraki (JP); Masaaki Terano, Nara (JP); Fumiaki Oobayashi, Osaka (JP); Toshiyuki Miyake, Hirakata (JP); Satoru Kuno, Nagoya (JP); Masayuki Harada, Nagoya (JP)

(73) Assignees: Panasonic Electric Works Co., Ltd., Osaka (JP); National University Corporation Nagoya University, Aichi (JP)

( * ) Notice: Subject to any disclaimer, the term of this patent is extended or adjusted under 35 U.S.C. 154(b) by 540 days.

(21) Appl. No.: 11/883,528

(22) PCT Filed: Jan. 30, 2006

(86) PCT No.: PCT/JP2006/301900

§ 371 (c)(1),
(2), (4) Date: Aug. 1, 2007

(87) PCT Pub. No.: WO2006/082939

PCT Pub. Date: Aug. 10, 2006

(65) Prior Publication Data

US 2008/0135634 A1 Jun. 12, 2008

(30) Foreign Application Priority Data

Feb. 2, 2005 (JP) ..... 2005-026841

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |
| *F28F 27/00* | (2006.01) |
| *F24F 3/00* | (2006.01) |
| *B60H 1/00* | (2006.01) |

(52) U.S. Cl. ..... 700/276; 700/277; 700/278; 700/291; 700/295; 165/200; 165/203; 165/205; 165/288

(58) Field of Classification Search ..... 700/276–278, 700/291, 295; 165/200, 203, 205, 288–289; 236/1, 44

See application file for complete search history.

(56) References Cited

U.S. PATENT DOCUMENTS 4,290,480 A * 9/1981 Sulkowski ..... 165/228

(Continued)

FOREIGN PATENT DOCUMENTS

| | | |
|---|---|---|
| JP | 2003-254593 | 9/2003 |
| JP | 2004-205202 | 7/2004 |

OTHER PUBLICATIONS

International Search Report for Int'l Appln. No. PCT/JP2006/301900 dated May 7, 2006.

Written Opinion of the International Searching Authority for Int'l Appln. No. PCT/JP2006/301900 dated May 7, 2006.

*Primary Examiner*—Ramesh B Patel
(74) *Attorney, Agent, or Firm*—Cheng Law Group, PLLC

(57) ABSTRACT

An environmental apparatus control system assures a consistent temperature control for realizing a comfortable residential environment based upon demands from the residents, yet in an energy-saving manner. The system includes an apparatus for controlling a residential space, and an initializer which provides an initial target value for control of the residential space at the start of operating the system. Comfortableness demands from residents are analyzed in order modify the initial target value to a working target value. The initial target value is shifted in a direction of saving the energy such that the working target value can always approach from and settle on the energy-saving side as the demands from the residents are analyzed. The working target values within a past time period are weighted to give a corrected target value which replaces the initial target value for the start of next operation cycle of the system.

3 Claims, 8 Drawing Sheets

U.S. PATENT DOCUMENTS 4,809,516 A * 3/1989 Jones ..... 62/160
4,909,041 A * 3/1990 Jones ..... 62/99
5,219,119 A * 6/1993 Kasper et al. ..... 236/46 R
5,517,429 A * 5/1996 Harrison ..... 342/378
5,600,406 A * 2/1997 Aikawa et al. ..... 399/70
5,762,265 A 6/1998 Kitamura et al.
5,909,378 A * 6/1999 De Milleville ..... 700/276
6,665,590 B2 * 12/2003 Harada et al. ..... 700/291
6,945,324 B2 * 9/2005 Weng ..... 165/218
2003/0033165 A1 * 2/2003 Inoue et al. ..... 705/1
2003/0083788 A1 * 5/2003 Harada et al. ..... 700/291
2004/0245351 A1 12/2004 Orfield et al.

* cited by examiner

FIG. 6A

*COLLECTED DEMANDS*

| TIME | A | B | C | D |
|---|---|---|---|---|
| 9:58 | −1 | | 0 | |
| 9:59 | | 1 | | |
| 10:00 | | | | |
| 10:01 | | | | 1 |
| 10:02 | | | | |
| 10:03 | | −1 | | |
| 10:04 | | | | |
| ··· | | | | |
| ··· | | | | |
| 10:57 | | −1 | | 1 |
| 10:58 | | | | |
| 10:59 | | | −1 | |
| 11:00 | −1 | | | |
| 11:01 | | | | |
| 11:02 | | | | |
| 11:03 | | | | 1 |
| 11:04 | | | | |
| 11:05 | | | | |

FIG. 6B

*EFFECTIVE DEMANDS*

| TIME | A | B | C | D |
|---|---|---|---|---|
| 9:58 | −1 | | 0 | |
| 9:59 | −1 | 1 | 0 | |
| 10:00 | −1 | 1 | 0 | |
| 10:01 | −1 | 1 | 0 | 1 |
| 10:02 | −1 | 1 | 0 | 1 |
| 10:03 | −1 | −1 | 0 | 1 |
| 10:04 | −1 | −1 | 0 | 1 |
| ··· | −1 | −1 | 0 | 1 |
| ··· | −1 | −1 | 0 | 1 |
| 10:57 | −1 | −1 | | 1 |
| 10:58 | | −1 | | 1 |
| 10:59 | | −1 | −1 | 1 |
| 11:00 | −1 | −1 | −1 | 1 |
| 11:01 | | | | 1 |
| 11:02 | | | | 1 |
| 11:03 | | | | 1 |
| 11:04 | | | | 1 |
| 11:05 | | | | 1 |

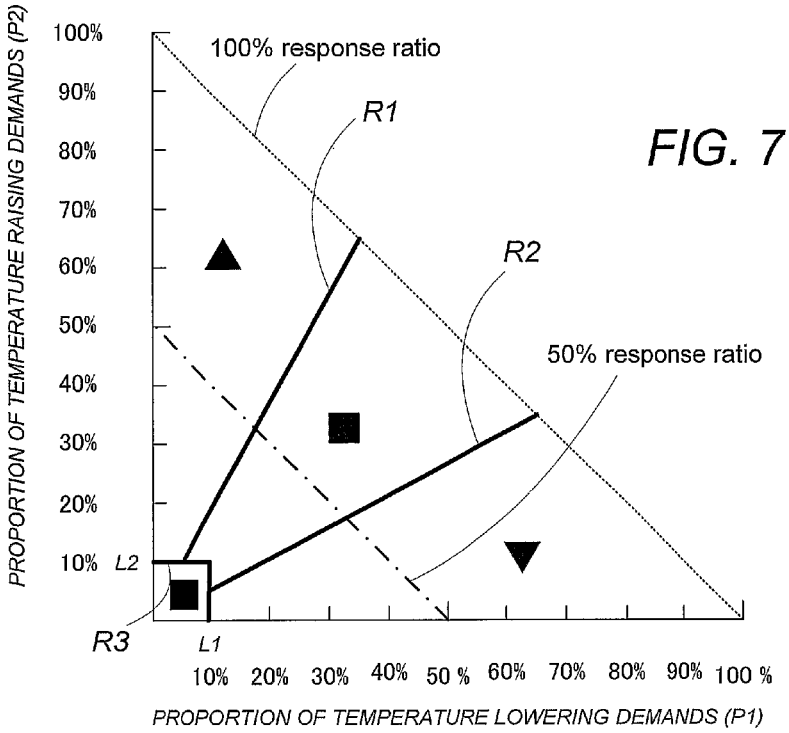
FIG. 7
FIG. 8
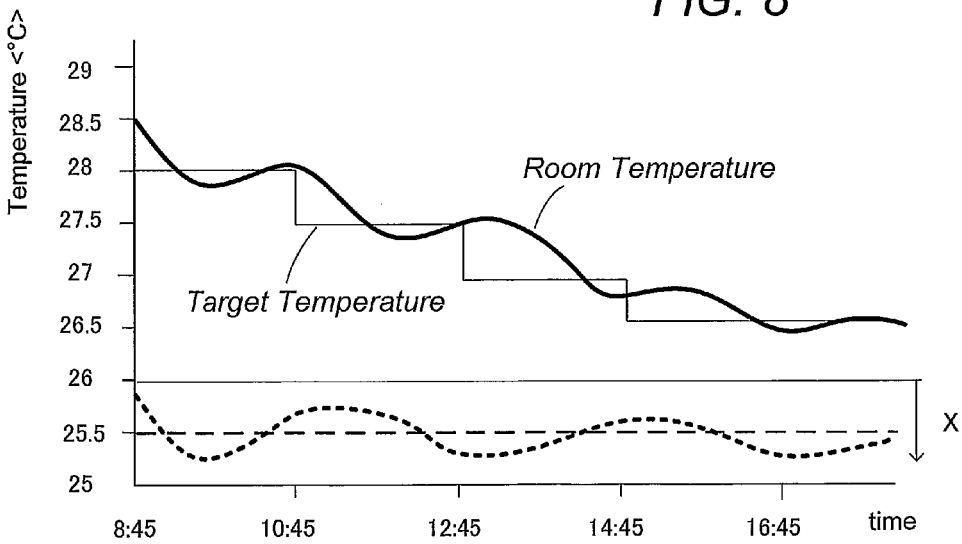

| TARGET TEMP | AMBIENT TEMP | WARM/ COOL | R1 | R2 |
|---|---|---|---|---|
| 27 | 25-40 | COOL | 75° | 45° |
| 26 | 25-40 | COOL | 60° | 30° |
| 25 | 25-40 | COOL | 45° | 25° |
| ... | | | | |

ENVIRONMENTAL APPARATUS CONTROL SYSTEM

TECHNICAL FIELD

The present invention relates to an environmental apparatus control system for control of an environmental apparatus such as air conditioning apparatus.

BACKGROUND ART

There has been an increasing social concern of energy saving due to global warming for controlling environmental apparatus, for example, air conditioning apparatus installed in buildings. BEMS (Building and Energy Management System) is now proposed to optimize energy management in the building. Actually, most of building administrators do not always operate and manage the environmental apparatus properly in view of energy-saving and comfortableness. Especially for temperature control of an enclosed residential space in the building where the comfortableness may conflict with the energy-saving, it has been a common practice to rely solely upon a customary temperature setting and adjust the temperature setting upon request by residents.

Since the temperature control has been made without sufficient consideration of the building characteristics and the resident's preference, the residential space is not always kept at an optimum condition that the residents feel comfort, and even the energy for the air conditioning apparatus may be wasted. Further, the residents may have complaints about that he or she is not able to control the environment on his or her own initiative.

In order to cope with the above problem, Japanese Patent Publication No. 2004-205202 proposes a system for controlling the temperature environment in reflectance of demands from the residents, i.e., temperature raising demand, i.e., temperature lowering demand, and temperature keeping demand. The system is configured to provide an initial target temperature based upon environmental parameters such as ambient air temperature, radiant temperature, humidity, air velocity metabolic rate, and cloth index. Then, the system collects and analyzes the demands from the residents so as to modify the initial target temperature to a working target temperature based upon the analysis of the demands, and instructs to vary or maintain the environmental temperature towards or at the working temperature for satisfying the predominant demand each time the system analyzes the demands.

In the above system, the initial target temperature (Ts') is set to be around a center of a comfortable range (X) which is determined by the above environmental parameters and is given by use of a known prediction of thermal comfort, for example, Fanger's comfort equation. As shown in FIG. 5A, the center of the comfortable range (X) is indicative of a temperature (Ts') at which most of the residents are predicted to feel comfortable. In other words, the system starts always with the temperature (Ts') at the expense of considerable energy consumption, regardless of the fact that there may be another starting temperature which may satisfy the predominant demand from the residents and at the same time save the energy. In this sense, the prior art system is insufficient to achieve the temperature control in consistent with the demands from the residents, while focusing on the energy-saving.

DISCLOSURE OF THE INVENTION

In view of the above insufficiency, the present invention has been accomplished to provide an environmental apparatus control system which is capable of making a consistent temperature control for realizing a comfortable residential environment based upon the demands from the residents, yet in an energy-saving manner. The system in accordance with the present invention includes an apparatus which is configured to control a residential environment or enclosed residential space, and an initializer which provides an initial target value for control of the residential space by the apparatus at the start of operating the system. The system further includes a demand collector for collecting comfortableness demands from individual residents, a project composer, and an apparatus controller. The project composer is configured to give an analysis of the comfortableness demands so as to modify the initial target value to a working target value based upon the analysis, and to provide a specific control project of realizing the working target value through the apparatus controller. Thus, the system permits the use of the initial target value shifted in a direction of saving the energy such that the working target value can always approach from and settle on the energy-saving side as the demands from the residents are analyzed to update the control project, thereby achieving the energy-saving control. The initial target value is updated after the end of each one of operation cycles, for example, the end of daily operation, so as to be ready for the operation on the next day. For this purpose, a calibrator is included in the system to collect the working target values obtained within a predetermined past time period. Thus collected working target values are weighted to give a corrected target value which replaces the initial target value for the next start of operating the system. Accordingly, the system can start with the corrected target value for achieving the consistent control in consideration of the demands, yet saving the energy.

The calibrator may be configured to obtain a running average of the working target values each determined at the end of each one of operation cycles repeated during the predetermined past time, and to give the corrected target value which is a sum of the running average and a predetermined offset. By suitably selecting the offset, the initial target value can be set always on the energy-saving side for fulfilling the environmentally friendly and energy saving control.

Preferably, the initializer is configured to collect the environmental parameters for evaluation of a comfortable range within which the residents are predicted to feel comfort, and to set the initial target value which is beyond the comfortable range in a direction of saving the energy which the apparatus consumes. The initial target value can be given, for example, by use of the known prediction of thermal comfort, for example, Fanger's comfort equation, so as to be shifted towards the energy saving side while taking into the consideration of the thermal comfort.

These and still other advantageous features of the present invention become more apparent from the following detailed description of the preferred embodiment when taken in conjunction with the attached drawings.

BRIEF DESCRIPTION OF THE DRAWINGS

FIGS. 6A and 6B are respective tables utilized in the above system for processing demands from the residents;

FIG. 7 is a graph illustrating a selection of a control project through an analysis of the demands;

FIG. 8 is a graph illustrating a working target temperature that is caused by the system to vary with time.

BEST MODE FOR CARRYING OUT THE INVENTION

Figure 1:
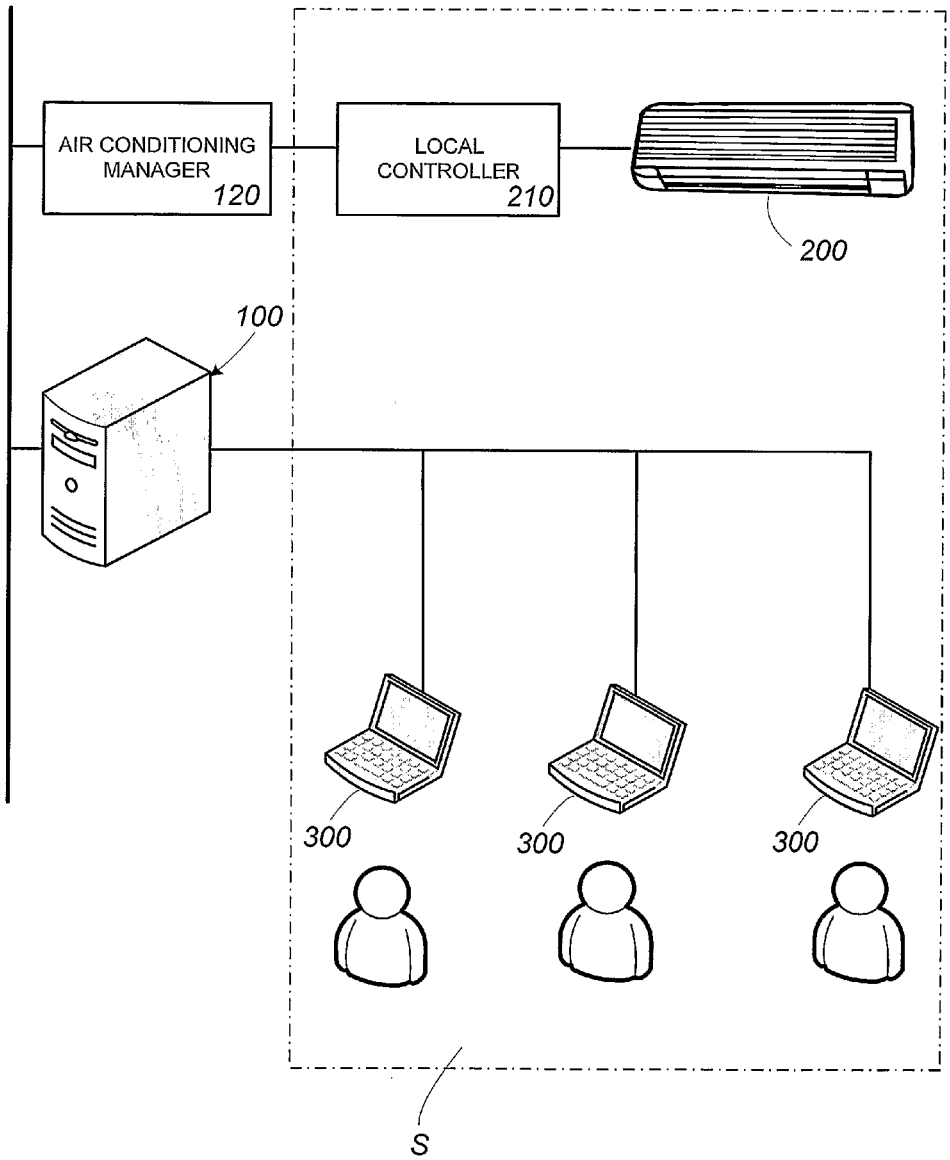
FIG. 1 is a block diagram illustrating an environmental apparatus control system in accordance with a preferred embodiment of the present invention.
Figure 2:
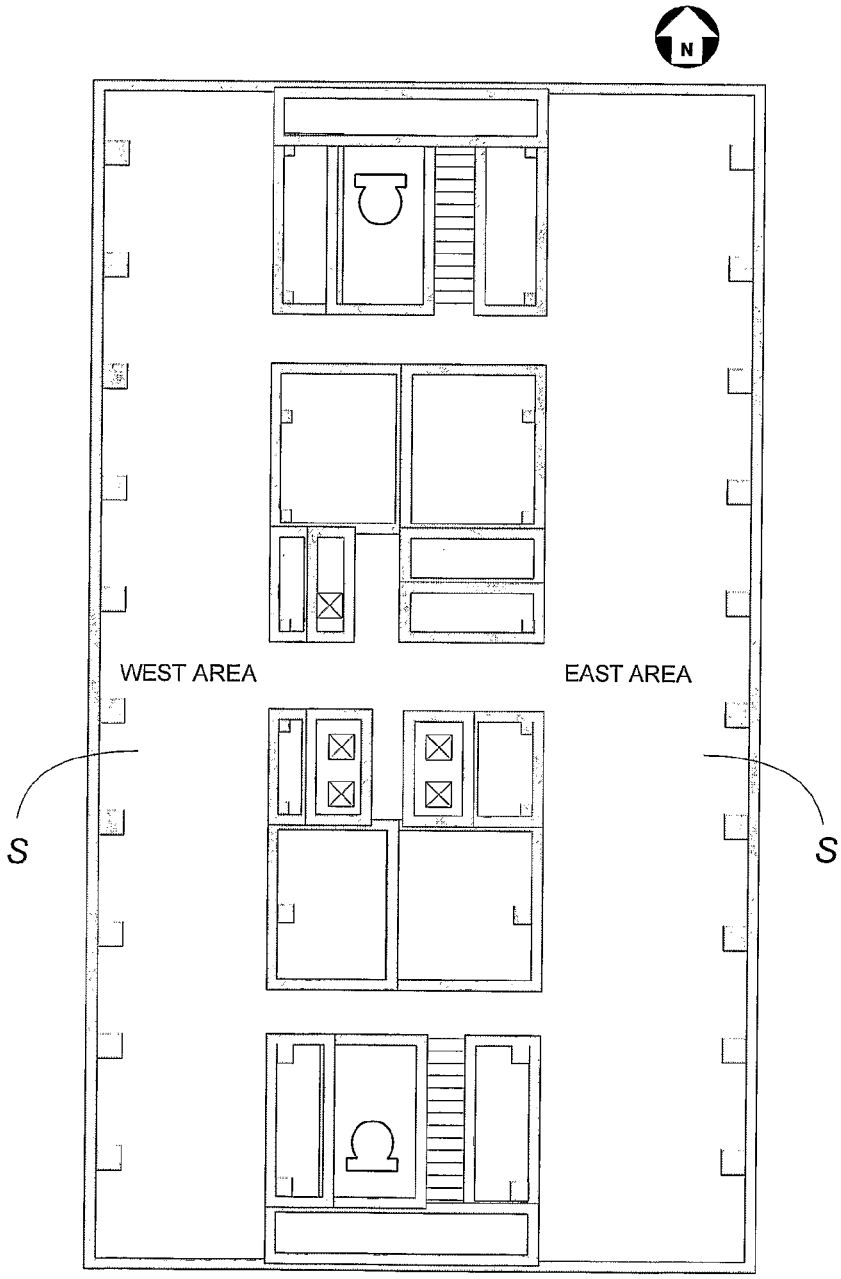
FIG. 2 is a plan view of an environmental space of a building which is controlled by the above system.

Referring now to FIGS. 1 and 2, there is shown an environmental apparatus control system in accordance with a preferred embodiment of the present invention. In the present embodiment, the system is specifically configured to control air-conditioning apparatus 200 for managing a temperature of an enclosed residential space in a building in consideration of demands from residents present in the space, although the present invention is not limited thereto. For example, the system is introduced for controlling the environmental temperature of a relatively large space (S) where many residents or persons are present such as office rooms or areas in the building as shown in FIG. 2.

Figure 3:
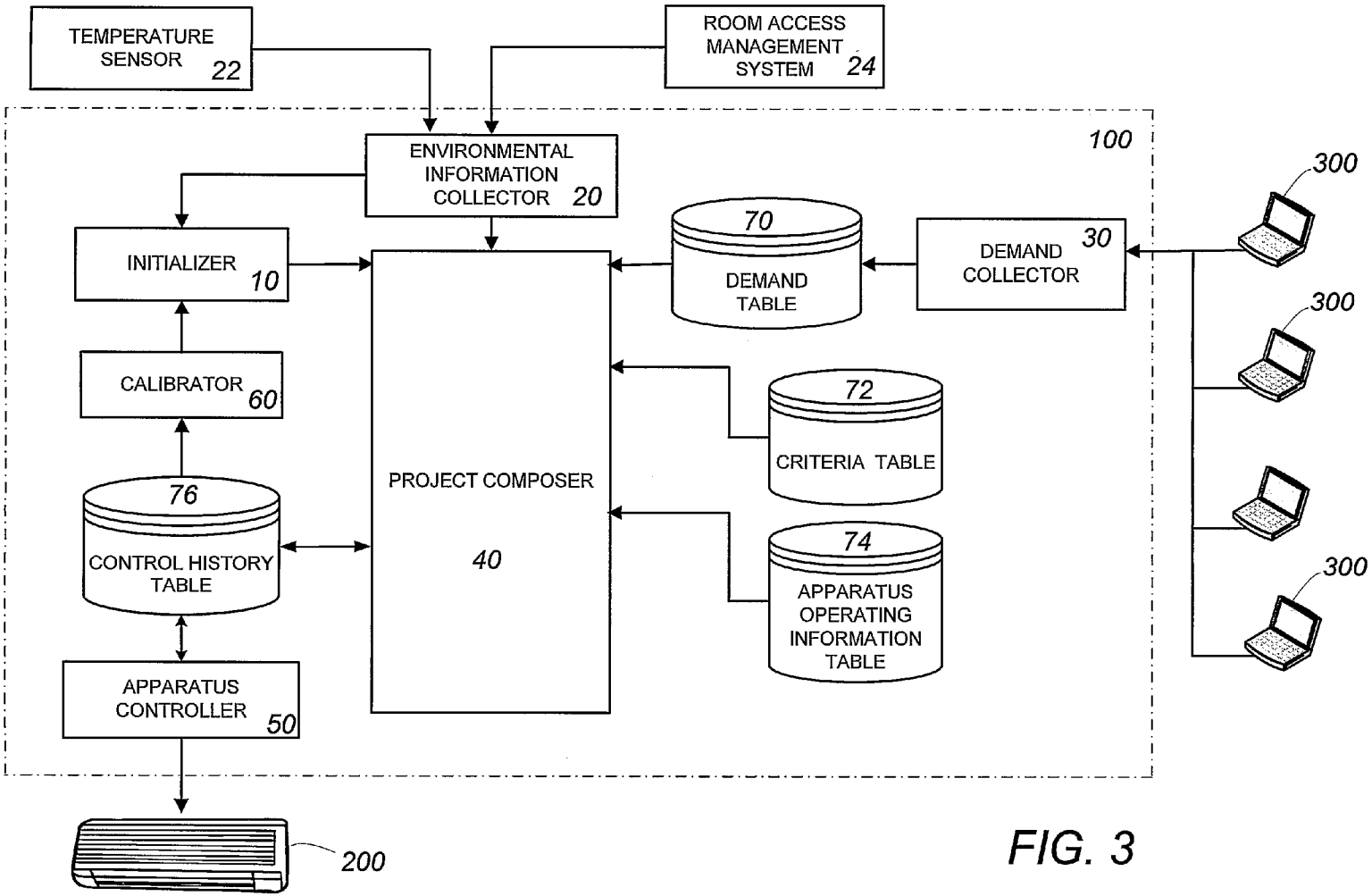
FIG. 3 is a block diagram illustrating a configuration of the above system.
Figure 4:
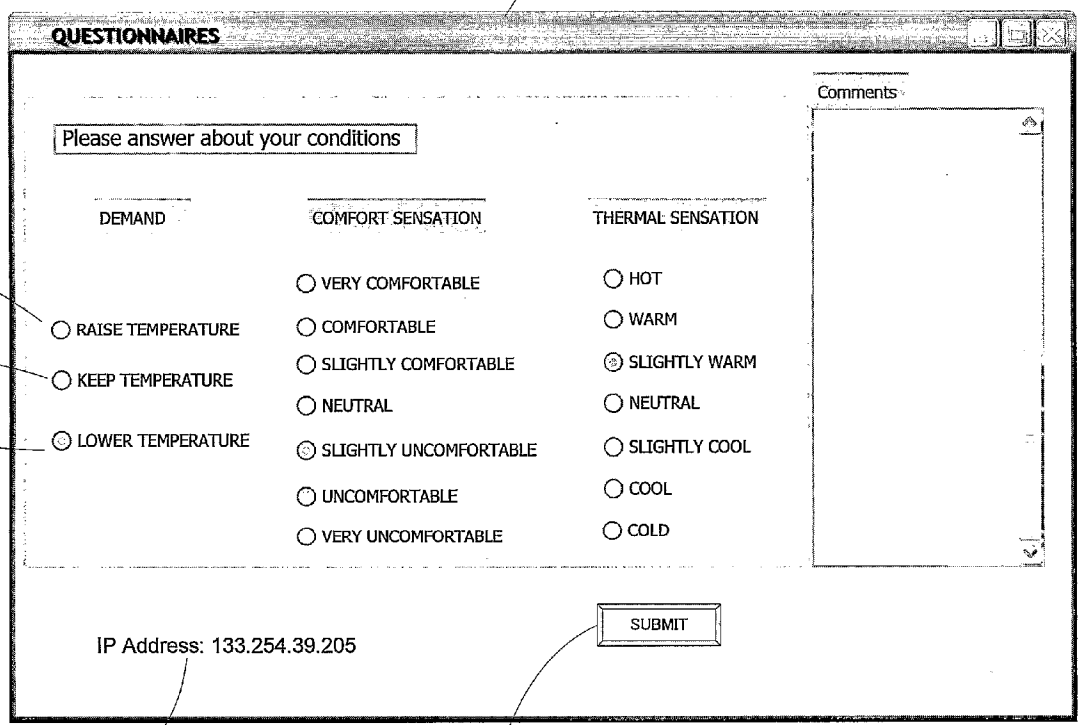
FIG. 4 is a view illustrating an input window form appearing in a personal terminal belonging to each resident in the environmental space.

The system includes a server 100 connected through a network to a plurality of personal terminals 300 such as personal computers respectively belonging to residents in the residential space As shown in FIG. 3, the server 100 is configured to provide functional units which are combined to determine a control project for controlling the air-conditioning apparatus 200 in consideration of the demands of the residents collected through the personal terminals 300. The units basically include an initializer 10, a demand collector 30, an environmental information collector 20, a project composer 40, and an apparatus controller 50. The system is designed to run on a dairy basis, i.e. to start and stop within 24 hours. In this connection, the initializer 10 is configured to provide an initial target temperature at the start of operating the system. The demand controller 30 is configured to collect at regular intervals, for example, 1 minute an identification code or a specific address assigned to each of the terminals 300 and a resident's demand submitted at each terminal 300. For this purpose, each terminal 300 is programmed to generate on its display an input window form 310 as shown in FIG. 4, prompting the resident to submit the demand, i.e., "raise temperature", "keep temperature", or "lower temperature" by selecting one of radio buttons 311, 312, and 313, and pressing a button 314. The input window form 310 also includes a label 316 indicating the address of the terminal 300.

Further, the input window form 310 includes entries of "comfort sensation" and "thermal sensation" each in seven grades, in addition to a text box for receiving a comment by the resident. The respective answers are sent to the sever 100 to be analyzed thereat to create a statistical report to be reviewed by an administrator of the building.

The demand is submitted together with the address of the terminal to the demand collector 30 and is then written into a demand table 70 which is stored in a storage means (not shown) in the server 100 to give time series data of the demands as related to the address of the associated terminal. The address can be utilized to identify the residential space, a location of the terminal in the space, and the associated air-conditioning apparatus 200 by referring to a predetermined relation table in the storage means. The environmental information collector 20 is configured to collect a room temperature from a temperature sensor 22 as well as the number of the residents present in the space from a room access management system 24.

Figure 5A:
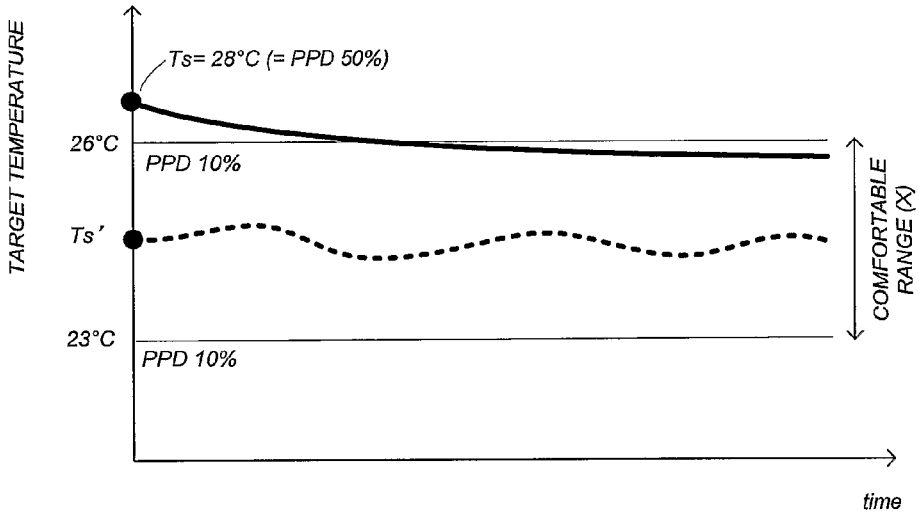
FIGS. 5A and 5B are graphs respectively illustrating the operation of the above system.

The initial target temperature (Ts) is obtained by use of Fanger's comfort equation of predicted mean vote (PMV) index and an associated predicted percentage dissatisfied (PPD) index. In this instance, the initial target temperature is defined to be the temperate at 50% PPD, i.e., at which 50% of the residents are predicted not to satisfy the thermal environment. PPD and PMV are both functions defined respectively by the following equations.

$$PPD=100-95\cdot e^{-(0.0335PMV^4+0.2179PMV^2)}$$

$$PMV=f(Ta, Tr, H, V, Icl, M)$$

where Ta is an ambient or room temperature, Tr is a radiant temperature, H is a humidity, V is a air velocity, Icl is a cloth index of a clothing worn by the resident; and M is a metabolic rate. Thus, 50% PPD (initial target temperature) is determined by the above environmental parameters. In the present embodiment, Ta, Tr, H, and V are monitored by respective sensors and collected at the environmental information collector 20, while Icl and M are entered by the administrator in consideration of the specific condition of the room or the environmental space. As shown in FIG. 5A, the initial target temperature (Ts) thus determined is beyond a comfortable range (X) in a direction of saving the energy. For instance, Ts is set to be 28° C. when cooling is required. In this instance, the comfortable range (X) is defined by PPD of 10% or less to be between 23° C. to 26° C. In FIG. 5A, the It is noted that the above initial target temperature is determined only once at the very start of running the system unless the system is reset by the administrator, and is corrected or updated each time after the daily operation is finished. Within the dairy operation, the initial target temperature is modified to a working target temperature which varies according to the demands from the residents in a manner as discussed below.

The project composer 40 is configured to determine the control project by analyzing the demands collected from the terminals 300 with reference to criteria stored in a criteria table 72 and also with reference to the operating condition of the air-conditioning apparatus 200 in an apparatus operating information table 74, details of which will be explained later. The control project includes a target temperature to be achieved by the air-conditioning apparatus 200, an operating mode indicative of warming or cooling, and an apparatus index identifying the air-conditioning apparatus. The control project is stored in a control history table 76 which is constantly referred by the apparatus controller 50 so that the apparatus controller 50 retrieves the updated control project in order to create a current temperature management signal. The signal is sent through the network to an air-conditioning manager 120 which distributes the signal to a local controller 210 for the air-conditioning apparatus identified by the control project, as shown in FIG. 1. Upon receiving the signal, the local controller 210 provides a control signal to the air-conditioning apparatus 200 for raising, lowering, or keeping the temperature.

Figure 5B:
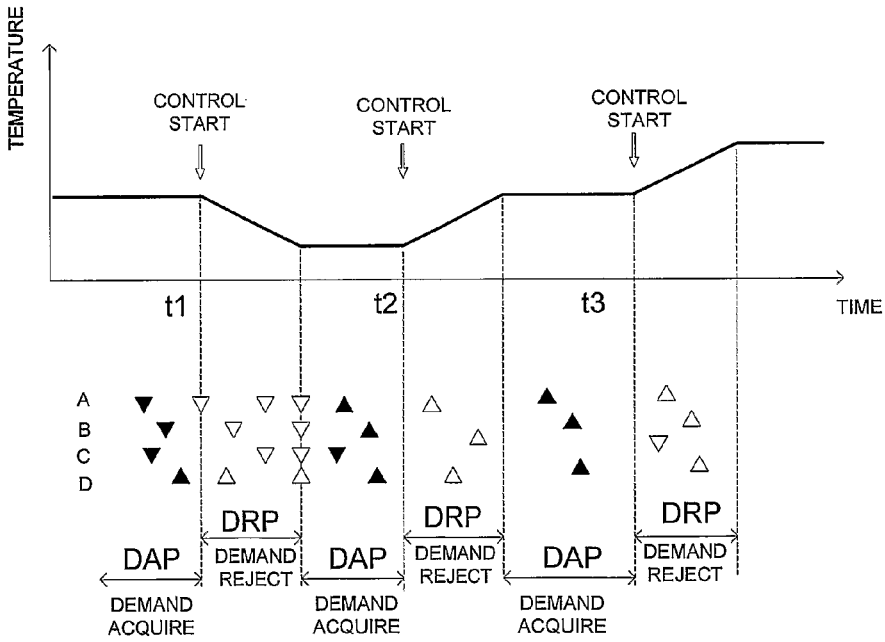

Now, details of determining the control project are discussed with reference to FIGS. 5B to 9. After the environmental information collector 20 collects the number of the residents (step 1 in FIG. 9), the project composer 40 reads the data from the demand table 70 at every one (1) minute to obtain effective demand from each terminal to calculate the count of the residents respectively demanding to raise temperature, to lower temperature, and to keep temperature. The effective demand is defined as a most recent demand from each terminal 300 during an immediately previous demand acquisition period DAP, as shown in FIG. 5B, in which the demands respectively from four terminals or residents "A", "B", "C", and "D" are shown for an easy understanding purpose, and the demand of raising temperature and the demand of lowering temperature are respectively indicated by "▲" and "▼". In order to obtain the effective demand, the project composer 40 processes time series data of the collected demands as indicate by a table of FIG. 6A into corresponding time series data as indicated by a table of FIG. 6B in order to decide the kind of the demands from each of the terminal at every 1 minute. In these tables, "1", "0", and "−1" indicate respectively the demands of raising temperature, keeping temperature, and lowering temperature, while a blank cell indicates that no demand or response is made from the corresponding terminal within the immediately previous demand acquisition period DAP. It is noted that the project composer 40 is configured to give a demand rejection period DRP corresponding to a period in which the temperature is varying in accordance with the control project, and during which the project composer 40 is inhibited from making the control project, i.e., refusing the demands. The demand rejection period is expected to be approximately 30 minutes. For example, when the temperature is settled at time t1 (11:00), the project composer 40 reads the effective demands at 11:00 from the table of FIG. 6B, and obtains the respective counts of the demands of raising temperature and lowering the temperature in order to determine the control project with reference to criteria stored in the criteria table 72. It is noted in this connection that the apparatus controller 50 is configured to read the control history table 76 at intervals longer than the cycle (one minute in this instance) at which the control project is determined. In other words, the control project is made at every one minute during the demand acquisition period DAP, i.e., until the apparatus controller 40 reads the control history table 40 to start the corresponding control over the air-conditioning apparatus 200.

In the present embodiment, the system is configured to provide a criterion as represented by a graph of in FIG. 7. The criterion has a first references R1 and a second reference R2, each being a function of a first proportion (P1) of the count of the temperature lowering demands in the total number of the residents present in the space, and a second proportion (P2) of the count of the temperature raising demands in the total number of the residents. The first and second references R1 and R2 is set to have different coefficients or gradient angles such that a right-angled isosceles triangular area defined by the rectangular coordinates of the first and second proportions (P1 and P2) is divided into three separate zones, namely, a temperature lowering zone "▼", a neutral zone "■", and a temperature raising zone "▲". The criterion additionally includes a square neutral zone "■" delimited by third reference lines R3 each corresponding to a first lower limit L1 (=10% P1) and a second lower limit L2 (=10% P2).

The gradient angles of the first and second references R1 and R2 are varied depending upon parameters including the current target temperature read from the control history table 76, the operating condition of the air-conditioning apparatus read from the apparatus operating information table 74, and a current ambient temperature being monitored by a temperature sensor. As shown in the below table, the criteria table 72 has a format designating the angles of the first and second references R1 and R2 in relation to different combinations of the current target temperature, the ambient temperature, and the operating condition (warming or cooling) of the apparatus.

| TARGET TEMPERATURE | AMBIENT TEMPERATURE | WARM/COOL | R1 | R2 |
|---|---|---|---|---|
| 27 | 25-40 | COOL | 75° | 45° |
| 26 | 25-40 | COOL | 60° | 30° |
| 25 | 25-40 | COOL | 45° | 25° |
| ... | ... | ... | ... | ... |

Upon receiving these parameters, the project composer 40 takes the first and second references from the criteria table 72 to establish a specific criterion (step 2 in FIG. 9) for determining the control project, i.e., raising, lowering or maintaining the temperature based upon the collected demands from the terminals 300. The project composer 40 obtains, based upon the effective demands from the demand table 50, a current first proportion of the count of the temperature raising demands in the total number of the residents present in the space, and a current second proportion of the count of the temperature lowering demands in the total number of the residents present in the space to give a current demand ratio of the current first proportion to the current second proportion (step 3 in FIG. 9). The current demand ratio is analyzed with reference to the selected criterion to determine a temperature variation (ΔT) which is to be added to the current target temperature (step 4 in FIG. 9). For example, when the current demand is within the temperature lowering zone "▼" in the graph of FIG. 7, i.e., the current demand is below the second reference R2, the temperature variation (ΔT) is set to be "−1". When the current demand ratio is in the neutral zone "■", i.e., between the first and second references R1 and R2, or below the third reference R3 in case of FIG. 7, ΔT=0. When the current demand ratio is in the temperature raising zone "▲", i.e., above the first reference R1, ΔT=1.

Figure 9:
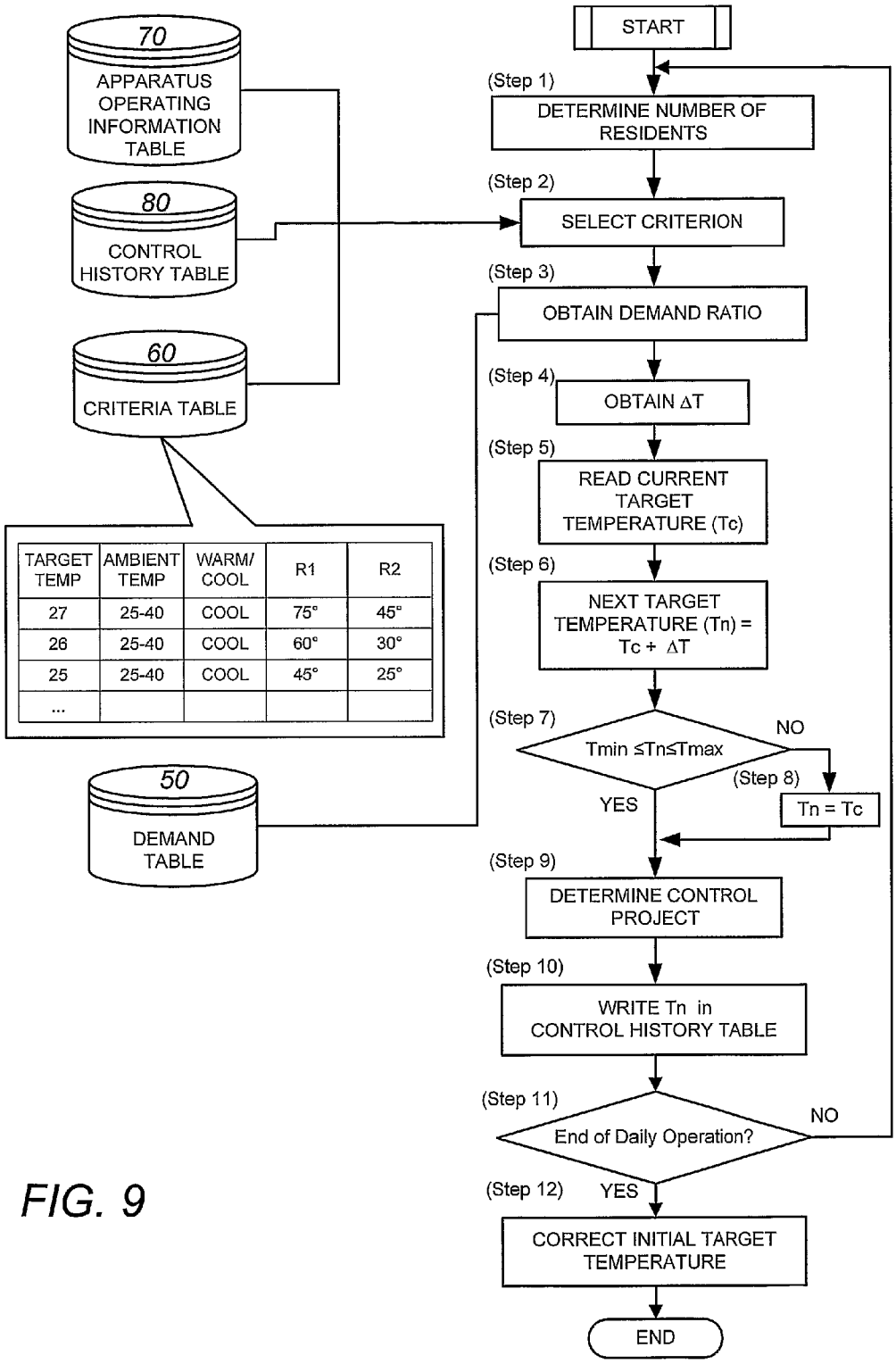
FIG. 9 is a flowchart illustrating the operation of the above system.

Then, the project composer 40 determines a next working target temperature (Tn) as the current target temperature (Tc)+ΔT (steps 5 & 6 in FIG. 9), and checks whether or not the next working target temperature (Tn) is within a predetermined range (Tmin=Tn=Tmax) (step 7 in FIG. 9). If not, the next working target temperature is reset to the current target temperature (Tn=Tc) (step 8 in FIG. 9). Otherwise, the next working target temperature (Tn) is validated and is written into the control history table 80 to update the same. At the same time, the next working target temperature is included in the control project and the control project is written into the control history table 76 (steps 9 & 10 in FIG. 9) for controlling the air-conditioning apparatus 200 in accordance with the control project for realizing the next target temperature in the space.

Since the initial target temperature (Ts=28° C.) is set beyond the comfortable range (X) where most of the residents are predicted to satisfy, the above demand-based control gives the working target temperature which lowers gradually as indicated by a stepwise line in FIG. 8 and is followed by the actual room temperature. With this result, the room temperature tends to settle on a relatively higher temperature on the energy-saving side than the case where the initial target temperature (=26.50° C.) is set within the comfortable range (X) so as to be followed by the actual room temperature by as indicated by dotted lines in FIG. 8.

The server 100 is further equipped with a calibrator 60 which, upon the end of the daily operation, reads the final target temperatures for a predetermined period, for example, past one week from the control history table 76, and weights the temperatures in order to give a corrected target temperature which defines the initial target temperature to be relied upon at the start of the next operation cycle (steps 11 & 12 in FIG. 9). Actually, the calibrator 60 obtains a moving average of the final target temperatures for past one week, and gives the corrected target temperature which is the sum of the moving average and a predetermine offset. The offset is set to be "−1" and "+1" respectively for heating and cooling conditions. The initializer 10 is activated at the start of each daily operation or operation cycle to provide thus determined initial target temperature for control of the temperature with reference to the demands from the residents as discussed in the above.

The invention claimed is:

1. An environmental apparatus control system comprising:

an apparatus configured to control a residential environment;

an initializer configured to provide an initial target value for control of said residential environment by said apparatus at the start of operating said environmental apparatus control system;

a demand collector connected through a network to a plurality of terminals and configured to collect comfortableness demands from each of said plurality of terminals;

a project composer configured to give an analysis of said comfortableness demands so as to modify said initial target value to a working target value based upon said analysis, and to provide a specific control project of realizing said working target value;

an apparatus controller configured to control said apparatus in accordance with said specific control project;

wherein said environmental apparatus control system further includes:

a calibrator configured to collect said working target values obtained within a predetermined past time period and to weight thus collected working target values for giving a corrected target value, said calibrator replacing said initial target value by said corrected target value for a next start of operating said environmental apparatus control system.

2. The environmental apparatus control system as set forth in claim 1, wherein said calibrator is configured to obtain a running average of said working target values each determined at the end of each one of operation cycles repeated during said predetermined past time, and to give said corrected target value which is a sum of said running average and a predetermined offset.

3. The environmental apparatus control system as set forth in claim 1, wherein said initializer is configured to collect said environmental parameters with respect to said residential environment for evaluation of a comfortable range within which residents are expected to show comfortableness, said initializer being configured to set said initial target value which is beyond said comfortable range in a direction of saving energy which said apparatus consumes.

* * * * *